US011678774B2

(12) United States Patent
Kim

(10) Patent No.: US 11,678,774 B2
(45) Date of Patent: Jun. 20, 2023

(54) FLUID DISPENSER

(71) Applicant: Jae Hong Kim, Seoul (KR)

(72) Inventor: Jae Hong Kim, Seoul (KR)

( * ) Notice: Subject to any disclaimer, the term of this patent is extended or adjusted under 35 U.S.C. 154(b) by 0 days.

(21) Appl. No.: 17/669,917

(22) Filed: Feb. 11, 2022

(65) Prior Publication Data

US 2022/0160183 A1 May 26, 2022

Related U.S. Application Data

(63) Continuation of application No. PCT/KR2021/000449, filed on Jan. 13, 2021.

(30) Foreign Application Priority Data

Sep. 7, 2020 (KR) ..... 10-2020-0113532

(51) Int. Cl.
*A47K 5/12* (2006.01)
*B05B 11/10* (2023.01)

(52) U.S. Cl.
CPC ..... *A47K 5/1204* (2013.01); *B05B 11/1002* (2023.01); *B05B 11/1097* (2023.01)

(58) Field of Classification Search
CPC ..... A47K 5/1204; B05B 11/1002; B05B 11/1097; B05B 11/1067; B05B 11/0027; B05B 11/0032; B05B 11/0037; B05B 11/0044; B05B 11/00442; B05B 11/0062; B05B 11/1052; B05B 11/1042; B65D 83/0005
See application file for complete search history.

(56) References Cited

U.S. PATENT DOCUMENTS 524,245 A * 8/1894 Chameroy ..... A01C 7/18 222/328
1,333,547 A * 3/1920 Johnson ..... F16N 5/00 222/394
1,707,084 A * 3/1929 Jaden ..... F16N 3/08 222/324

(Continued)

FOREIGN PATENT DOCUMENTS

JP 06-032865 8/1994
JP 2892289 B2 5/1999

(Continued)

*Primary Examiner* — Bob Zadeh
(74) *Attorney, Agent, or Firm* — Knobbe, Martens, Olson & Bear, LLP

(57) ABSTRACT

This application relates to a fluid dispenser. In one aspect, the dispenser includes a body including an opening and an accommodating space for accommodating fluid, a lid for closing the opening, a pressing unit disposed on a side of the body, and a discharge unit disposed on the side at a position diagonally higher than the pressing unit and configured to discharge a predetermined amount of the fluid from the accommodating space when a pressure is applied to the pressing unit. The dispenser may also include a pump mechanism configured to pump the predetermined amount of the fluid from the accommodating space to the discharge unit when the pressure is applied to the pressing unit, and an air intake formed on a part of the lid and configured to flow air into the accommodating space when the predetermined amount of the fluid is discharged from the accommodating space.

14 Claims, 13 Drawing Sheets

(56) References Cited

U.S. PATENT DOCUMENTS

| | | | | | |
|---|---|---|---|---|---|
| 2,159,894 | A * | 5/1939 | Hines | A61M 11/02 | 239/362 |
| 5,638,994 | A * | 6/1997 | Libit | G01F 11/084 | 222/215 |
| 5,842,609 | A * | 12/1998 | Higgins | A47K 5/1204 | 137/513.5 |
| 6,213,358 | B1 * | 4/2001 | Libit | B05B 11/0056 | 222/215 |
| 2003/0185620 | A1 * | 10/2003 | Park | A46B 11/0055 | 401/270 |
| 2005/0230425 | A1 * | 10/2005 | Genosar | B05B 11/026 | 222/533 |
| 2022/0160183 | A1 * | 5/2022 | Kim | A47K 5/1204 | |

FOREIGN PATENT DOCUMENTS

| | | | | |
|---|---|---|---|---|
| JP | 6816325 | B1 * | 1/2021 | A47K 5/1204 |
| KR | 1994-0007264 | | 10/1994 | |
| KR | 940007264 | Y1 * | 10/1994 | |
| KR | 20-0347812 | Y1 | 4/2004 | |
| KR | 10-0849356 | B1 | 7/2008 | |

* cited by examiner

FLUID DISPENSER

CROSS-REFERENCE TO RELATED APPLICATIONS

This application is a continuation of International Application No. PCT/KR2021/000449, filed Jan. 13, 2021, which is based upon and claims the benefit of priority from Korean Patent Application No. 10-2020-0113532 filed Sep. 7, 2020, which is now Korean Patent No. 10-2295553, the contents of which are incorporated herein by reference in their entirety.

BACKGROUND

Technical Field

The present disclosure relates to a fluid dispenser.

Description of the Related Technology

A fluid dispenser is used to discharge a predetermined amount of fluid accommodated in a closed fluid container by pressing the fluid with a pump mechanism, which is applied to containers for shampoo, liquid soap, foam soap, cosmetics, sterilizer, and the like.

SUMMARY

According to some embodiments of the present disclosure, a fluid dispenser includes a body including an opening and an accommodating space for accommodating fluid, a lid for closing the opening of the body, a pressing unit disposed on a side of the body, a discharge unit disposed on the side of the body at a position diagonally higher than the pressing unit and configured to discharge a predetermined amount of the fluid from the accommodating space when a pressure is applied to the pressing unit, a pump mechanism configured to pump the predetermined amount of the fluid from the accommodating space to the discharge unit when the pressure is applied to the pressing unit, and an air intake formed on a part of the lid and configured to flow air into the accommodating space when the predetermined amount of the fluid is discharged from the accommodating space by the pressure applied to the pressing unit. The discharge unit is positioned, when a user holds the body with one hand with a thumb on the pressing unit and presses the pressing unit with the thumb, to drop the predetermined amount of the fluid on the one hand between a metacarpal of the thumb and a metacarpal of a forefinger.

The above and other objects, features, advantages and technical and industrial significance of this invention will be better understood by reading the following detailed description of presently preferred embodiments of the invention, when considered in connection with the accompanying drawings.

DETAILED DESCRIPTION

A typical fluid dispenser includes a pressing unit and a discharge unit on a top of a container. When a pressure is applied to the pressing unit in a vertical direction, a piston moves down to discharge the fluid by an amount corresponding to a movement of the piston (see, for example, Korean Pat. No. 10-0849356).

A trigger-type dispenser includes a nozzle head disposed on a top portion of a container. When a user pulls a trigger of the nozzle head in a horizontal direction, a movement of a piston coupled to the trigger causes a predetermined amount of fluid to be discharged in a direction opposite to a direction of pulling the trigger (see, for example, Japanese Pat. No. 2892289).

With the fluid dispenser described in Korean Patent No. 10-0849356, the container is placed on a floor, and a user presses the pressing unit with one hand and receives the fluid with a palm of the other hand.

When a user has to use only one hand to press the pressing unit and receive the fluid discharged, it is hard to handle a fluid dispenser of a vertical pressing type such as the one described in Korean Patent No. 10-0849356 because the fluid dispenser easily slips on the floor.

In particular, when washing a baby or a pet, it may be necessary to hold the baby or the pet with one hand and to handle a fluid dispenser with the other hand only. In this case, a fluid dispenser that can be used with only one hand to press the pressing unit and to receive the fluid discharged in a safe and stable manner is needed.

Exemplary embodiments of the present disclosure are described in detail below with reference to the accompanying drawings.

It is an object of the present disclosure to provide a fluid dispenser that is portable and can be used with only one hand to apply a pressure and to receive discharged fluid with safety and stability.

The challenges to be addressed by the present disclosure are not limited to those mentioned above, and other unmentioned problems can be clearly understood by those skilled in the art from the following description.

Figure 1:
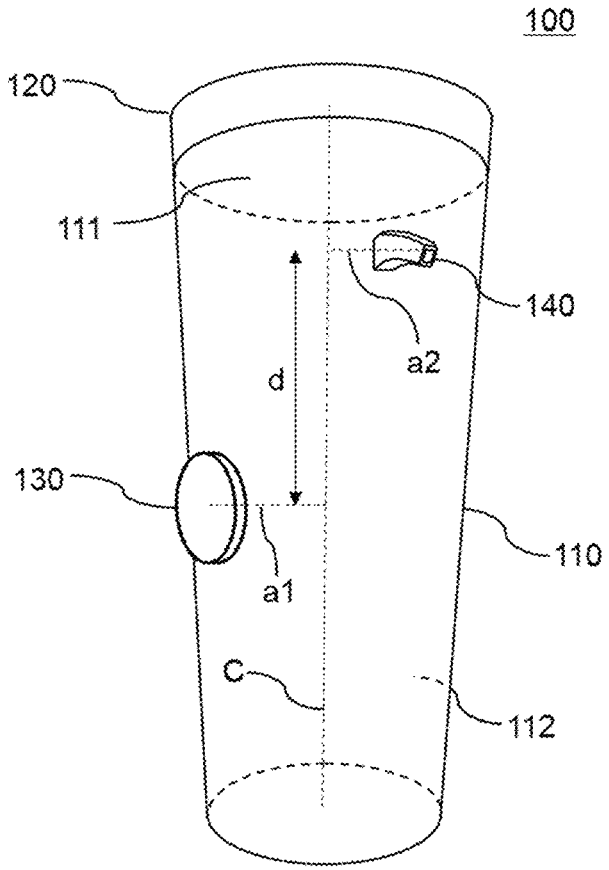
FIG. 1 is a perspective view of a fluid dispenser according to some embodiments of the present disclosure.
Figure 2:
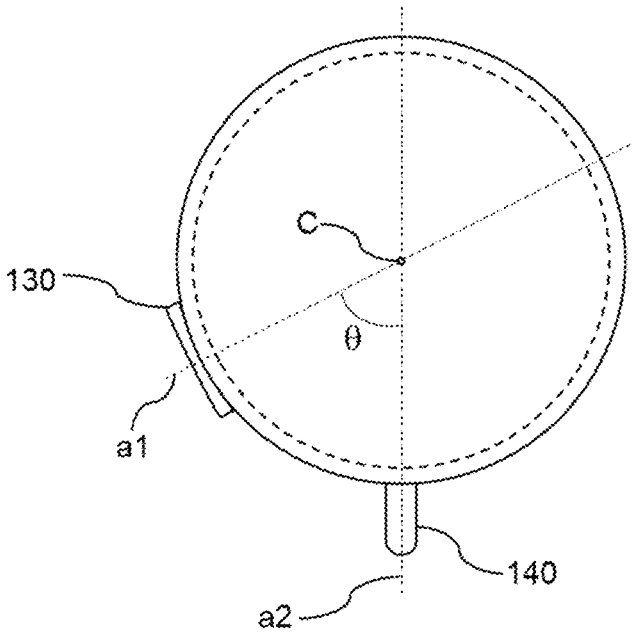
FIG. 2 is a top view of the fluid dispenser shown in FIG. 1.

FIG. 1 is a perspective view of a fluid dispenser 100 according to some embodiments of the present disclosure. FIG. 2 is a top view of the fluid dispenser 100 shown in FIG. 1.

As shown in FIGS. 1 and 2, the fluid dispenser 100 according to some embodiments of the present disclosure includes a body 110 including an opening 111 and an accommodating space 112 for accommodating fluid, a lid 120 for closing the opening 111 of the body 110, a pressing unit 130 disposed on a side of the body 110, a discharge unit 140 disposed on the side of the body 110 at a position diagonally higher than the pressing unit 130 and configured to discharge a predetermined amount of the fluid from the accommodating space 112 when a pressure is applied to the pressing unit 130, a pump mechanism (see FIGS. 8 and 9) configured to pump the predetermined amount of the fluid from the accommodating space 112 to the discharge unit 140 when the pressure is applied to the pressing unit 130, and an air intake (see FIGS. 8 to 13) formed on a part of the lid 120 and configured to flow air into the accommodating space 112 when the predetermined amount of the fluid is discharged from the accommodating space 112 by the pressure applied to the pressing unit 130.

In some embodiments of the present disclosure, the pressing unit 130 is disposed at a position with a predetermined distance d from the pressing unit 130 in the upper direction to make a predetermined angle θ with the pressing unit 130 centering around a center C of the body 110.

In some embodiments of the present disclosure, the pump mechanism is disposed in the accommodating space 112 or on an internal wall or inside a wall of the body 110.

As shown in FIGS. 1 and 2, the pressing unit 130 and the discharge unit 140 are positioned with a predetermined distanced therebetween in the vertical direction, in a manner that a line a1 that connects the pressing unit 130 and the center C of the body 110 in a direction normal to the center C and a line a2 that connects the discharge unit 140 and the center C of the body 110 in a direction normal to the center C makes a predetermined angle θ. That is, the discharge unit 140 is positioned at a position distant from the pressing unit 130 by the predetermined angle θ in a radial direction of the body 110 in the top view.

Figure 3:
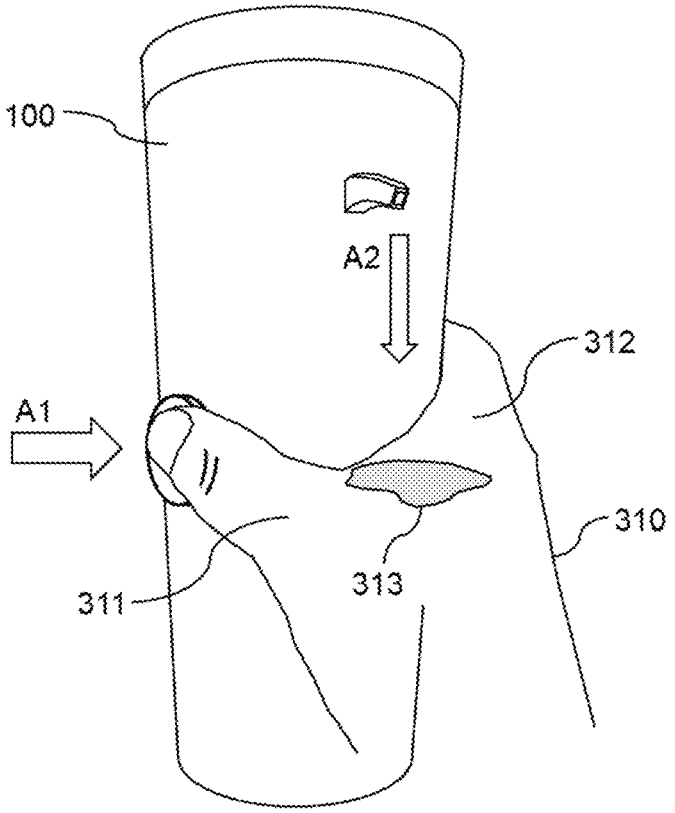
FIG. 3 is a perspective view of the fluid dispenser shown in FIG. 1, showing an example of using it with only one hand.

FIG. 3 is a perspective view of the fluid dispenser 100 shown in FIG. 1, showing an example of using it with only one hand.

In some embodiments of the present disclosure, as shown in FIG. 3, the discharge unit 140 is positioned, when a user holds the body 110 with one hand 310 with a first finger (thumb) on the pressing unit 130 and presses the pressing unit 130 in a direction of an arrow A1 towards the center C of the body 110 with the thumb, to drop the predetermined amount of the fluid 313 on the one hand 310 between a metacarpal of the thumb 311 and a metacarpal of a forefinger 312.

That is, in the example shown in FIG. 3, as the predetermined amount of the fluid 313 drops on the one hand 310 between a metacarpal of the thumb 311 and a metacarpal of a forefinger 312 when the user holds the body 110 with the one hand 310 with the first finger (thumb) on the pressing unit 130 and presses the pressing unit 130 in the direction of the arrow A1 towards the center C of the body 110 with the thumb, when it is hard to use the other hand, it is possible to press the pressing unit 130 and to receive the fluid with safety and stability.

Although the example shown in FIGS. 1 to 3 is for a right-handed person, for a left-handed person, the pressing unit 130 or the discharge unit 140 can be positioned on the other side of the body 110 or a second discharge unit 140 can be disposed on a position opposite to the discharge unit discharge unit 140, which has a symmetric relationship with respect to the pressing unit 130.

In this manner, the fluid dispenser 100 according to some embodiments of the present disclosure can be movable independently and can be placed on the floor with the bottom facing downwards. The lid 120 is configured to close the opening 111 formed on the top of the body 110 from above.

Figure 4:
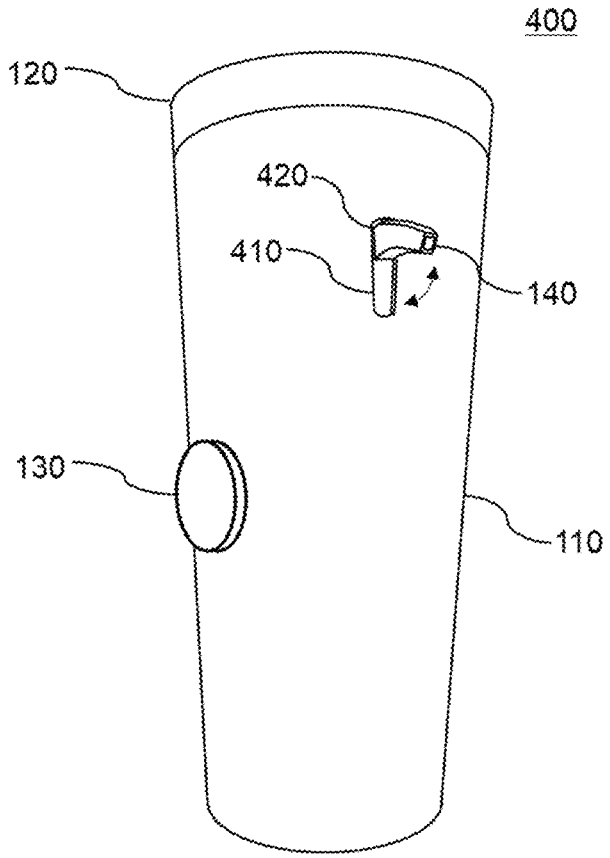
FIGS. 4 to 7 are perspective views of fluid dispensers according to some embodiments of the present disclosure.
Figure 5:
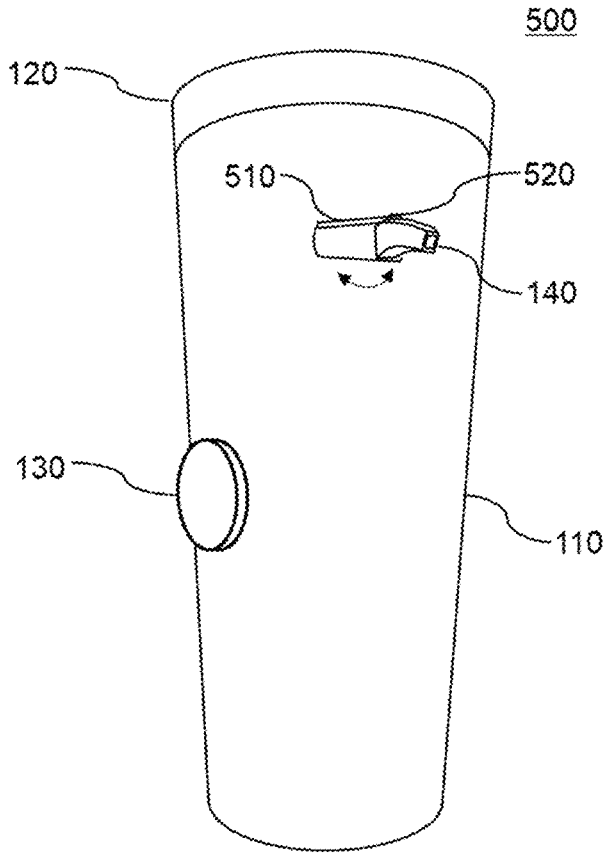
Figure 6:
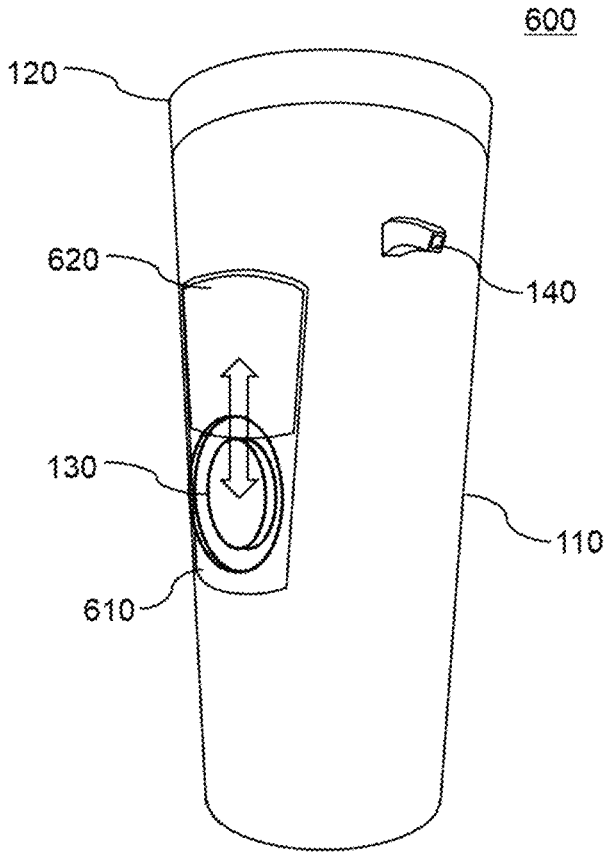
Figure 7:
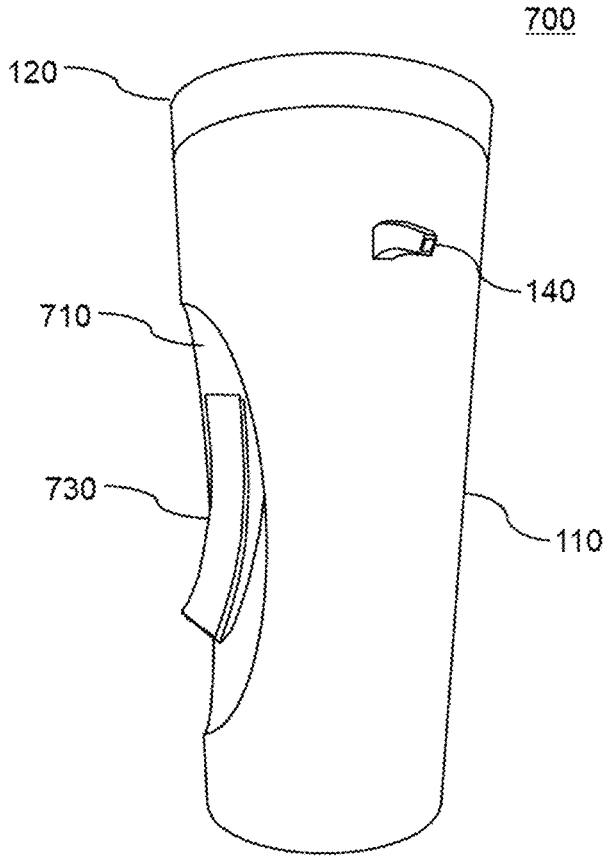

FIG. 4 is a perspective view of a fluid dispenser 400 according to some embodiments of the present disclosure. FIG. 5 is a perspective view of a fluid dispenser 500 according to some embodiments of the present disclosure. FIG. 6 is a perspective view of a fluid dispenser 600 according to some embodiments of the present disclosure. FIG. 7 is a perspective view of a fluid dispenser 700 according to some embodiments of the present disclosure.

In some embodiments of the present disclosure, as shown in FIG. 4, a fluid dispenser 400 includes an elongated recess 410 formed on at least one of an upper portion and a lower portion of the discharge unit 140 to accommodate the discharge unit 140 and a rotating unit 420 to rotate the discharge unit 140 in a direction along a longitudinal direction of the recess 410 by a predetermined angle.

That is, the discharge unit 140 is open when the discharge unit 140 is rotated in a first direction (upwards direction in FIG. 4) to allow the fluid to be discharged through the discharge unit 140 when the pressing unit 130 is pressed, and is closed when the discharge unit 140 is rotated in a second direction (downwards direction in FIG. 4) not to allow the pressing unit 130 to be pressed due to the internal pressure.

In some embodiments of the present disclosure, as shown in FIG. 5, a fluid dispenser 500 includes an elongated recess 510 formed on at least one of a left portion and a right portion of the discharge unit 140 to accommodate the discharge unit 140 and a rotating unit 520 to rotate the discharge unit 140 in a direction along a longitudinal direction of the recess 510 by a predetermined angle in the radial direction of the body 110.

That is, the discharge unit 140 is open when the discharge unit 140 is rotated in a first direction (right direction in FIG. 5) to allow the fluid to be discharged through the discharge unit 140 when the pressing unit 130 is pressed, and is closed when the discharge unit 140 is rotated in a second direction (left direction in FIG. 5) not to allow the pressing unit 130 to be pressed due to the internal pressure.

In some embodiments of the present disclosure, as shown in FIG. 6, a fluid dispenser 600 includes a concave portion 610 around the pressing unit 130, and the pressing unit 130 is disposed within the concave portion 610 not to protrude from a contour of the body 110 over the concave portion 610.

In this manner, by forming the concave portion 610 on the body 110 not to cause the pressing unit 130 to protrude from the body 110, it is possible to prevent the pressing unit 130 from being pressed accidently when carrying the fluid dispenser 600.

In some embodiments of the present disclosure, the fluid dispenser 600 further includes a closing unit 620 for opening and closing the concave portion 610 along the contour of the body 110 over the concave portion 610.

The closing unit 620 is configured to slidingly move over the concave portion 610 in the vertical direction or in the horizontal direction. In the example shown in FIG. 6, when using the fluid dispenser 600, the closing unit 620 is moved upwards to cause the pressing unit 130 to be exposed, and when not using the fluid dispenser 600, the closing unit 620 is moved downwards to cover the concave portion 610 not to allow the pressing unit 130 to be exposed.

Accordingly, by closing the closing unit 620, it is possible to surely prevent the pressing unit 130 from being accidently pressed when carrying the fluid dispenser 600.

In some embodiments of the present disclosure, as shown in FIG. 7, a fluid dispenser 700 includes a trigger 730 instead of the pressing unit 130 of a push button type.

In the same manner as the fluid dispenser 600 shown in FIG. 6, by disposing the trigger 730 in a concave portion 710 formed on the body 110, it is easier to use the fluid dispenser 700 with only one hand.

Figure 8:
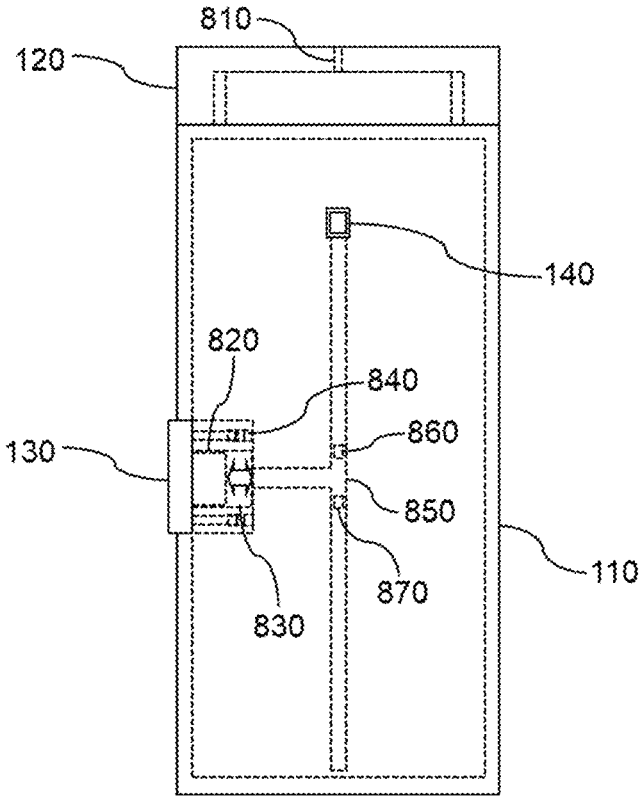
FIGS. 8 and 9 are lateral cross-sectional views of fluid dispensers according to some embodiments of the present disclosure.
Figure 9:
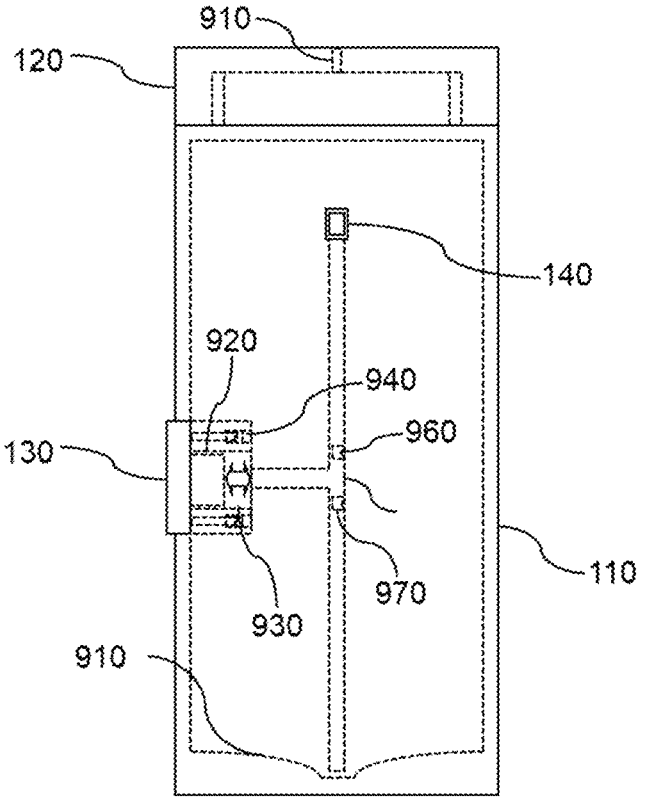

FIGS. 8 and 9 are lateral cross-sectional views of fluid dispensers according to some embodiments of the present disclosure.

In some embodiments of the present disclosure, as shown in FIG. 8, the pump mechanism includes the pressing unit 130 of the push button type or the trigger 730 disposed to apply the pressure in the direction normal to the center C of the body 110, a piston 820 coupled to the pressing unit 130 or the trigger 730, a cylinder 830 for allowing the piston 820 to move back and forth, an elastic member 840 for providing a restoring force when the pressing unit 130 or the trigger 730 is pressed, a T-shaped pipe 850 extended from the cylinder 830 and split into a first pipe coupled to the discharge unit 140 and a second pipe extended towards the bottom of the body 110, a first check valve 860 disposed in the first pipe, and a second check valve 870 disposed in the second pipe.

That is, when the pressing unit 130 of the push button type or the trigger 730 is pressed towards the center C, the piston 820 is moved in the cylinder 830 to transfer the pressure to the pipe 850. The second check valve 870 is then closed and the first check valve 860 is open to form a fluid path to the discharge unit 140. When the pressing unit 130 or the trigger 730 is released, the piston 820 is moved back to its original position due to the elastic force of the elastic member 840. The first check valve 860 is then closed and the second check valve 870 is open to allow the predetermined amount of the fluid to flow into the pipe 850 from the accommodating space 112.

In a state in which the fluid fills the pipe 850, when the pressing unit 130 or the trigger 730 is pressed, the second check valve 870 is closed and the first check valve 860 is open to allow the predetermined amount of the fluid to be discharged from the discharge unit 140.

A typical check valve member used a pump dispenser, such as a diaphragm, a check ball, or the like, can be used for the first check valve 860 and the second check valve 870.

As shown in FIG. 9, the fluid dispenser according to some embodiments of the present disclosure includes a slant 910 on the bottom of the body 110. The slant 910 is formed to be inclined downwards from the outside of the body 110 towards the bottom of the body 110.

By forming the slant 910 on the bottom of the body 110, even when the fluid in the accommodating space decreases down to near the bottom, it is possible to use the fluid without remaining some residual fluid on the bottom.

As shown in FIGS. 8 and 9, the air intake according to according to some embodiments of the present disclosure includes at least one air hole 910 formed on a top of the lid 120.

When the pressure is applied to the pressing unit 130 to discharge the predetermined amount of the fluid from the discharge unit 140, the air hole 910 allows the air of an amount corresponding to the amount of the discharged fluid to flow into the accommodating space 112.

In some embodiments of the present disclosure, the size of the air hole 910 is set in a manner that the air is allowed to pass through the air hole 910 but the fluid inside the accommodating space 112 is not allowed to pass through the air hole 910.

Figure 10:
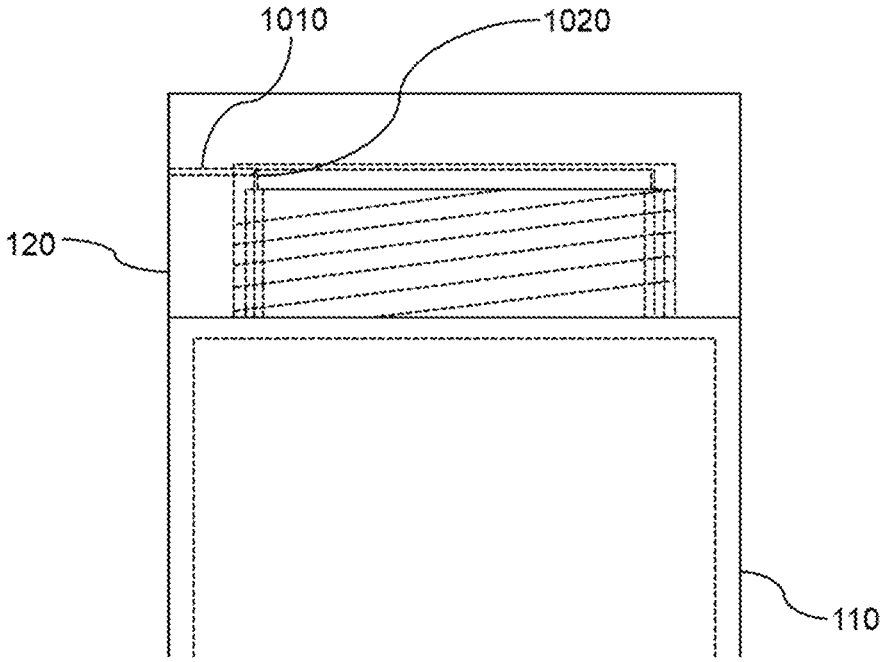
FIGS. 10 and 11 are partial cross-sectional views of upper parts of fluid dispensers according to some embodiments of the present disclosure.
Figure 11:
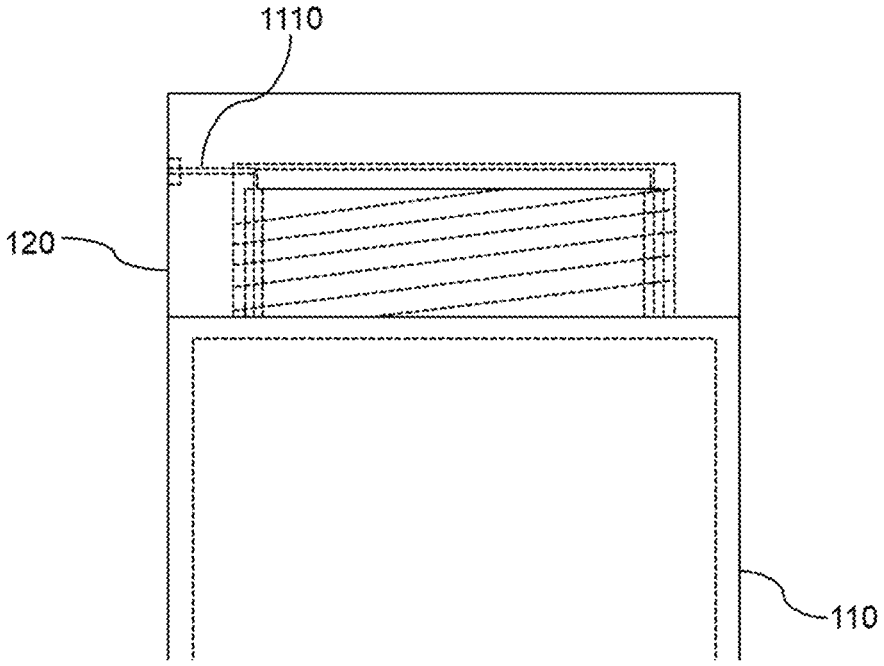

FIGS. 10 and 11 are partial cross-sectional views of upper parts of fluid dispensers according to some embodiments of the present disclosure.

In some embodiments of the present disclosure, the air intake includes at least one air hole 1010 or 1110 formed on the side of the lid 120.

As shown in FIG. 10, when the lid 120 is closed all the way, a top portion 1020 of the body 110 reaches a position to block the air hole 1010 to prevent the fluid from being leaked when carrying the fluid dispenser.

In some embodiments of the present disclosure, the air hole 1010 is configured to be open when the lid 120 is rotated in a first direction by a predetermined angle and to be closed when the lid 120 is rotated in a second direction opposite to the first direction by the predetermined angle in a state in which the lid 120 is closed.

As shown in FIG. 11, the air hole 1110 is configured to be automatically open when the internal pressure of the accommodating space 112 is lowered due to the discharge of the fluid and to be automatically closed when the internal pressure of the accommodating space 112 equals the atmosphere due to the air flown into the accommodating space 112.

Figure 12:
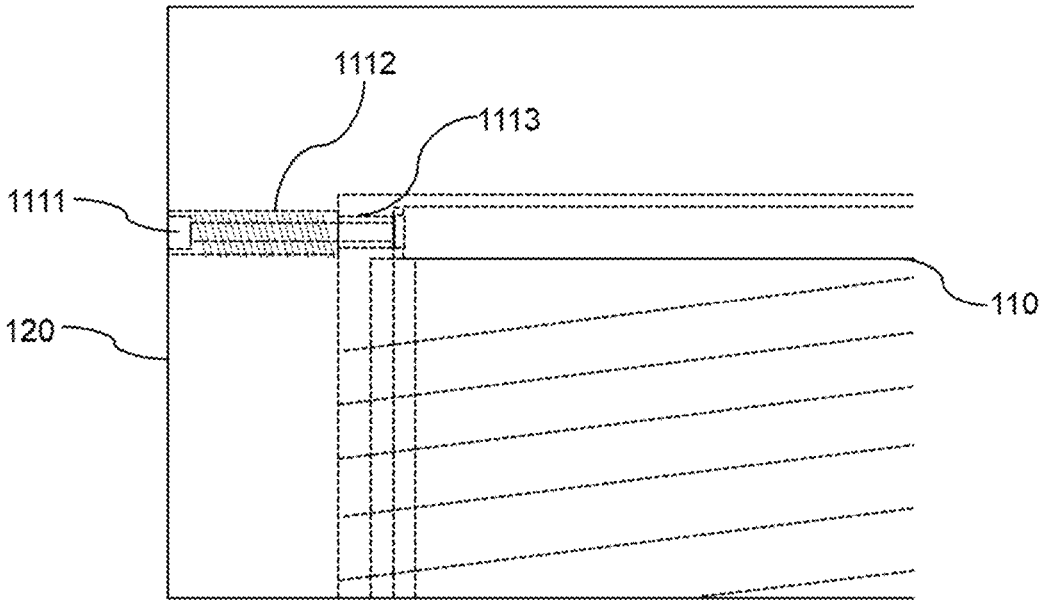
FIGS. 12 and 13 are detailed cross-sectional views of lids of fluid dispensers according to some embodiments of the present disclosure.
Figure 13:
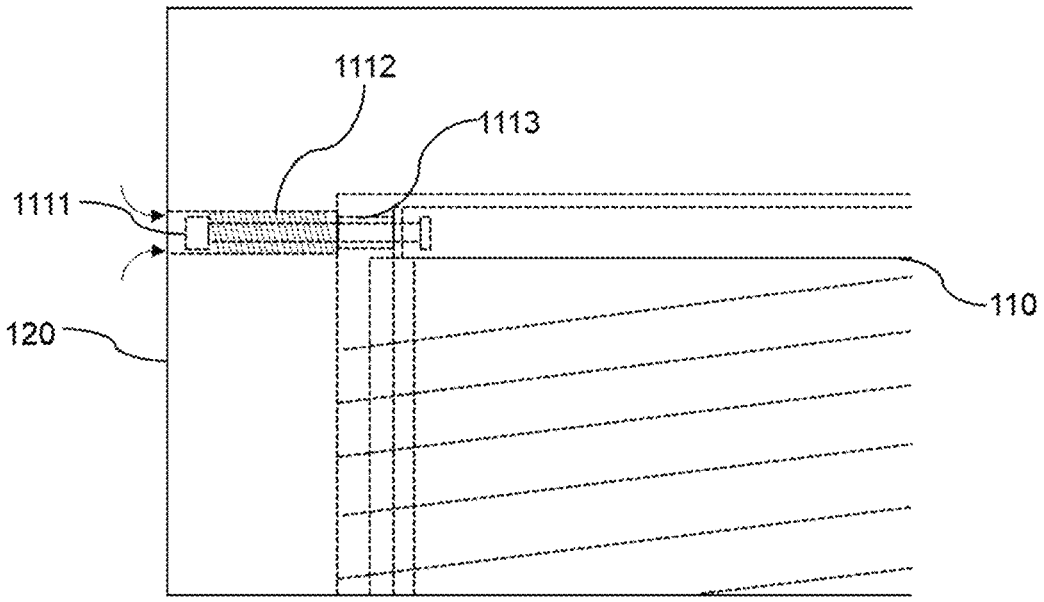

FIGS. 12 and 13 are detailed cross-sectional views of lids of fluid dispensers according to some embodiments of the present disclosure, showing an operation of the air hole 1110 shown in FIG. 11.

As shown in FIG. 12, the air hole 1110 includes a through hole 1113 on the side of the lid 120 and a pin 1111 slidingly inserted in the through hole 1113. An end portion of the pin 1111 in the inner side functions as a closing member to close the through hole 1113 from the inside, and the pin 1111 is inserted into a spring 1112 as an elastic member.

An end portion of the pin 1111 on the outer side of the lid 120 is formed as a rivet head to allow the spring 1112 to be fixed inside in a compressing manner.

As shown in FIG. 12, when the internal pressure of the body 110 equals the atmosphere, the air intake is closed by the tension of the spring 1112 due to the end portion of the pin 1111 in the inner side closing the through hole 1113. Accordingly, the air is prevented from flowing into the through hole 1113 in this state.

When the predetermined amount of the fluid is discharged due to the pressure applied to the pressing unit 130, the internal pressure of the accommodating space 112 decreases, and as shown in FIG. 13, the force of pulling the end portion of the pin 1111 in the inner side exceeds the tension of the spring 1112, then the pin 1111 is pulled inwards to allow the air to flow into the accommodating space 112 through a space between the through hole 1113 and the pin 1111 in the direction of arrows.

When the internal pressure of the accommodating space 112 becomes equal to the atmosphere due to the air flown into the accommodating space 112, the pin 1111 is pulled outwards due to the elastic force of the spring 1112. The end portion of the pin 1111 in the inner side then closes the through hole 1113 again to prevent the air from flowing into the accommodating space 112. Although a spring is used as the elastic member in the above explanation, the present disclosure is not limited to this scheme, but rubber, silicone, plastic, or the like can be used as the elastic member.

In some embodiments of the present disclosure, the pump mechanism can be disposed inside the accommodating space 112, on the inner all of the body 110, or inside the wall of the body 110.

As described above, some embodiments of the present disclosure can provide a fluid dispenser that is portable and can be used with only one hand to apply a pressure and to receive discharged fluid with safety and stability.

The present disclosure should not be limited to these embodiments but various changes and modifications are made by one ordinarily skilled in the art within the subject matter, the spirit and scope of the present disclosure as hereinafter claimed. Specific terms used in this disclosure and drawings are used for illustrative purposes and not to be considered as limitations of the present disclosure. Exemplary embodiments of the present disclosure have been described for the sake of brevity and clarity. Accordingly, one of ordinary skill would understand the scope of the claimed invention is not to be limited by the explicitly described above embodiments but by the claims and equivalents thereof.

What is claimed is:

1. A fluid dispenser, comprising:

a body including an opening and an accommodating space configured to accommodate fluid;

a lid configured to close the opening of the body;

a pressing unit disposed on a side of the body;

a discharge unit disposed on the side of the body at a position diagonally higher than the pressing unit and configured to discharge a predetermined amount of the fluid from the accommodating space when a pressure is applied to the pressing unit;

a pump mechanism configured to pump the predetermined amount of the fluid from the accommodating space to the discharge unit when the pressure is applied to the pressing unit; and an air intake formed on a part of the lid and configured to flow air into the accommodating space when the predetermined amount of the fluid is discharged from the accommodating space by the pressure applied to the pressing unit, the discharge unit positioned, when a user holds the body with one hand with a thumb on the pressing unit and configured to press the pressing unit with the thumb, to drop the predetermined amount of the fluid on the one hand between a metacarpal of the thumb and a metacarpal of a forefinger.

2. The fluid dispenser according to claim 1, wherein:

the body is portable and placeable in an upright manner with a bottom facing downwards, and the lid is configured to close the opening formed on a top of the body.

3. The fluid dispenser according to claim 1, further comprising:

a recess configured to accommodate the discharge unit; and a rotating unit configured to rotate the discharge unit in a direction along a longitudinal direction of the recess by a predetermined angle, wherein:

the discharge unit is configured to be open when the discharge unit is rotated in a first direction, and the discharge unit is configured to be closed when the discharge unit is rotated in a second direction opposite to the first direction.

4. The fluid dispenser according to claim 3, wherein the recess is formed longitudinally in a direction parallel to a center axis of the body.

5. The fluid dispenser according to claim 3, wherein the recess is formed longitudinally in a direction perpendicular to a center axis of the body.

6. The fluid dispenser according to claim 1, wherein the pump mechanism includes:

a piston extended from the pressing unit towards the accommodating space;

a cylinder configured to allow the piston to move back and forth;

an elastic member configured to provide a restoring force to the piston upon the piston being moved towards the accommodating space by the pressure applied to the pressing unit;

a T-shaped pipe extended from the cylinder and split into a first pipe coupled to the discharge unit and a second pipe extended towards a bottom of the body;

a first check valve disposed in the first pipe; and a second check valve disposed in the second pipe.

7. The fluid dispenser according to claim 1, wherein:

the body includes a concave portion around the pressing unit, and the pressing unit is disposed within the concave portion not to protrude from a contour of the body over the concave portion.

8. The fluid dispenser according to claim 7, further comprising a closing unit configured to open and close the concave portion along the contour of the body over the concave portion.

9. The fluid dispenser according to claim 1, further comprising a slant on a bottom of the body, the slant formed to be inclined downwards from an outside of the body towards a bottom of the body.

10. The fluid dispenser according to claim 1, wherein the air intake includes at least one air hole formed on a top of the lid.

11. The fluid dispenser according to claim 1, wherein the air intake includes at least one air hole formed on a side of the lid.

12. The fluid dispenser according to claim 11, wherein the at least one air hole is configured to be open when the lid is rotated in a first direction by a predetermined angle and to be closed when the lid is rotated in a second direction opposite to the first direction by the predetermined angle.

13. The fluid dispenser according to claim 11, wherein the at least one air hole is configured to be open when the predetermined amount of the fluid is discharged from the accommodating space so that a pressure inside the accommodating space is lowered and to be closed when the air inflows through the at least one air hole so that the pressure inside the accommodating space equals to an atmospheric pressure.

14. The fluid dispenser according to claim 1, further comprising an additional discharge unit disposed on a position opposite to the discharge unit, wherein the positions of the two discharge units have a symmetric relationship with respect to the pressing unit.

* * * * *